US005609530A

United States Patent [19]

Butler, Jr.

[11] Patent Number: 5,609,530

[45] Date of Patent: Mar. 11, 1997

[54] DYNAMIC LIE DETERMINATION DEVICE AND METHOD

[75] Inventor: Joseph H. Butler, Jr., Collierville, Tenn.

[73] Assignee: Emhart Inc., Newark, Del.

[21] Appl. No.: 522,442

[22] Filed: Aug. 31, 1995

[51] Int. Cl.[6] ..... A63B 69/36

[52] U.S. Cl. ..... 473/237; 473/409

[58] Field of Search ..... 273/232, 186.4; 473/237, 409

[56] References Cited

U.S. PATENT DOCUMENTS

| | | | |
|---|---|---|---|
| 922,773 | 5/1909 | Kempshall | 273/232 |
| 2,135,210 | 11/1938 | Farrar | 273/232 |
| 2,660,436 | 11/1953 | Grossman | 273/186.4 |
| 3,137,507 | 6/1964 | Pickler | 273/186.4 |
| 3,721,447 | 3/1973 | Louderbeck | 273/186.4 |
| 3,754,764 | 8/1973 | Manbeck | 273/186.4 |
| 3,806,132 | 4/1974 | Brandell | 273/186.4 |
| 4,284,276 | 8/1981 | Worst | 273/232 |
| 4,932,662 | 6/1990 | Blaisdell | 273/186.4 |
| 4,974,851 | 12/1990 | Closser et al. | 273/186.4 |
| 5,033,746 | 7/1991 | Jones | 273/186.4 |
| 5,142,309 | 8/1992 | Lee | 273/186.4 X |

*Primary Examiner*—George J. Marlo
*Attorney, Agent, or Firm*—E. D. Murphy

[57] ABSTRACT

An impressionable medium, such as a element 56, is secured to an impact face 30 of a head 22 of a golf club 20. Alterations, such as grooves 46, are formed in a surface 42 of a target object 40. The object 40 is placed on a level surface such as a surface pad 64 with the grooves 46 being perpendicular with a plane of the pad and positioned for being struck by the element 56 and the impact face 30. Impression lines 66 are formed in the element 56 by the grooves 46 when the club 20 is swung and the head 22 strikes the object 40. Impression lines 66 are a representation of the angular relationship between a bottom 34, or grooves 32, of the head 30 and the plane of the pad 64 at the instant the element 56 and the impact face 30 strike the target object 40. This representation can be used to determine the dynamic lie of the club 20 at the instant the target object 40 is struck.

26 Claims, 6 Drawing Sheets

DYNAMIC LIE DETERMINATION DEVICE AND METHOD

BACKGROUND OF THE INVENTION

This invention relates to a device for and methods of determining the dynamic lie of a golf club and to a target object used therewith and particularly relates to a device for and methods of determining the "toe up" and "toe down" conditions associated with a golfers swing and, further, to the structure of a target object used with the device and in the practice of the methods.

In the playing of the game of golf, a golfer uses a golf club to strike a golf ball and drive the ball through a flight trajectory. The club includes a shaft having a club head at a lower or tip end of the shaft and a grip at an upper or butt end of the shaft. The club head is secured to the tip end of the shaft and typically extends at a near right angle from the tip end. The club head further includes a club face which is the impact surface which the golfer moves into engagement with the golf ball when the club is swung by the golfer. The club face typically includes a series of spaced, parallel lines or grooves formed therein which are generally parallel with the bottom edge of the club face.

In playing the game of golf, it is desirable for the golfer to swing the club in such manner that the bottom of the club head and the lines or grooves on the face of the club are parallel to the plane of a surface on which the golf ball is situated. Generally, when the ball is struck by the face of the club head which is in this planar alignment, the ball will travel through a trajectory in a path selected and desired by the golfer. The position of the club head relative to the plane of the surface on which the golf ball rests at the instant the club face strikes the ball is commonly referred to as the "dynamic lie" of the club.

Frequently, when a golfer swings a club, the golfer may not be holding the club in the appropriate manner and the free end, or toe end, of the club head may be undesirably pointing downward, a "toe down" condition, or upward, a "toe up" condition. In any event, when a ball is struck by a club head which is in such a "toe down" or "toe up," the ball spins improperly and is launched in such a manner that the ball veers to the right or the left of the trajectory desired by, and the intended aim of, the golfer. Under these conditions, the unwanted effects of the improper dynamic lie of the club can be quite significant.

It is thus incumbent upon the golfer to determine that a "toe up" condition or a "toe down" condition exists and the degree of such condition. Only then can the golfer take the corrective measures necessary to enhance the golfers playing of the game.

One technique used to determine whether a "toe up" condition or a "toe down" condition exists involves the use of an artificial ground board on which a scuffing material is located. A golf ball is placed on the surface and an adhesive backed paper is adhesively secured to the bottom of the club head. The golfer then swings the club to hit the ball. If the club head is in a perfect position to the strike the ball, the bottom of the club, and the paper adhered thereto, will scrape the ground board generally on the center of the bottom of the head, thereby making scuff marks on the paper at this location. The so-located scuff marks provide an indicator that the golfer is holding and controlling the club properly when the club strikes the ball.

If the toe end of the club head is tilted downward or upward, the scuff marks will appear at a forward portion or a rearward portion, respectively, of the paper which is adhesively secured to the bottom of the head. This result provides an indication to the golfer that, when the head engages the ground board, the club is in a "toe down" or a "toe up" condition and a swing correction is necessary. This technique provides a relationship between the lie of the club head and the ground board but does not necessarily provide a relationship between the dynamic lie of club at the instant it strikes the golf ball. Depending on the manner in which the golfer is manipulating the club during the swing, significant changes can occur immediately before the club head strikes the ball which the above-described technique using a ground board would not detect.

Thus, there is a need for a device and a method for determining in a dynamic context the lie of the club at the instant that the club head strikes the ball.

SUMMARY OF THE INVENTION

It is an object of this invention to provide a simple inexpensive device and methods for determining the lie of a golf club at the instant the head of the club strikes a golf ball.

Another object of this invention is to provide a device and methods which will provide rapidly an accurate indication to a golfer of the dynamic lie of a golf club being swung by the golfer at the instant of impact of the head of the club with a golf ball.

Still another object of this invention is to provide a target object having structure which, when struck by the head of a golf club, facilitates an indication of the lie of the club at the instant the head struck the target object.

With these and other objects in mind, this invention contemplates a device for determining the lie of a golf club at the instant a strike face of a head of the club strikes a target object. The device includes an impressionable medium secured to the strike face of the club head and an impression-making structure formed in at least a portion of an outer surface of the target object.

This invention further contemplates a method of determining the dynamic lie of a golf club at the instant a strike face of the club impacts a target object. The method includes the steps of forming at least one alteration in a portion of a surface of the target object and positioning the object on a surface with the alteration being located in a prescribed orientation relative to the surface on which the object is being positioned. An impressionable medium is secured to the strike face of the head of the golf club and the club is swung so that the strike face with the impressionable medium is aimed to strike the area of the target object which includes the alteration on the surface thereof. An impression is formed in the medium when the strike face of the club impacts the target object whereby the impression formed in the medium represents the relative angular positioning between the prescribed orientation of the alteration on the target object and the dynamic lie of the club upon impact with the object.

This invention also contemplates a target object having at least one alteration formed in a surface of the object in a prescribed orientation and configuration.

Other objects, features, and advantages of the present invention will become more fully apparent from the following detailed description of the preferred embodiment, the appended claims and the accompanying drawings.

DETAILED DESCRIPTION OF THE PREFERRED EMBODIMENT

Figure 1:
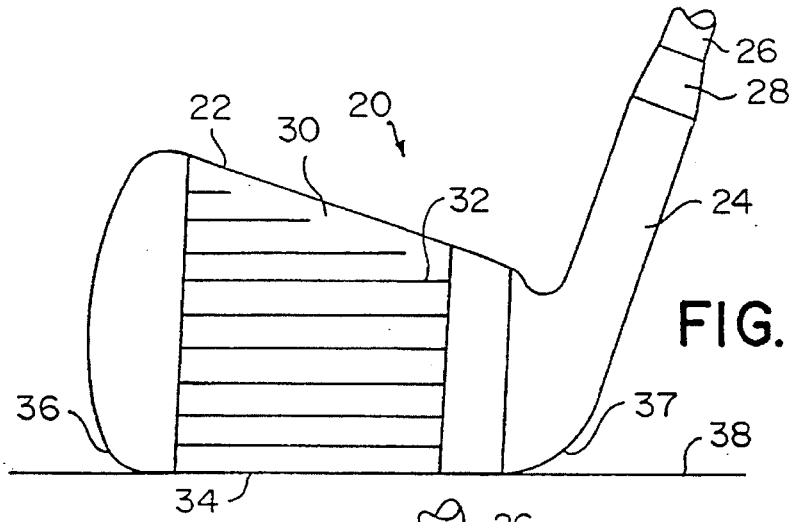
FIG. 1 is a side view showing a golf club head in a desirable lie with a surface.

Referring to FIG. 1, a golf club 20 includes a head 22 having a hosel 24 extending therefrom and a club shaft 26 assembled with the hosel. A ferrule 28 is located axially at the juncture of the hosel 24 and the shaft 26. The head 22 includes an impact face 30 which is formed with a plurality of spaced, parallel grooves 32 which are parallel with a bottom surface 34 of the head. A lower left or front corner of the head 22 is referred to as a toe 36 of the head. A lower right or rear corner of the head 22 is referred to as a heel 37 of the head.

While the illustrated club 20 is an "iron," other types of clubs such as, for example, "woods" could be used without departing from the spirit and scope of the invention.

As further shown in FIG. 1, the bottom surface 34 of the head 22 is parallel with a ground surface line or plane 38, as is the plurality of grooves 32 formed in the impact face 30 of the head. Ideally, when a golfer swings the club 20 to hit a golf ball situated on the ground surface line 38, the bottom surface 34 of the head 22 should be parallel with the ground surface line on which the golf ball is located in order to attain a desired trajectory of the ball after the impact face 30 strikes the ball.

Figure 2:
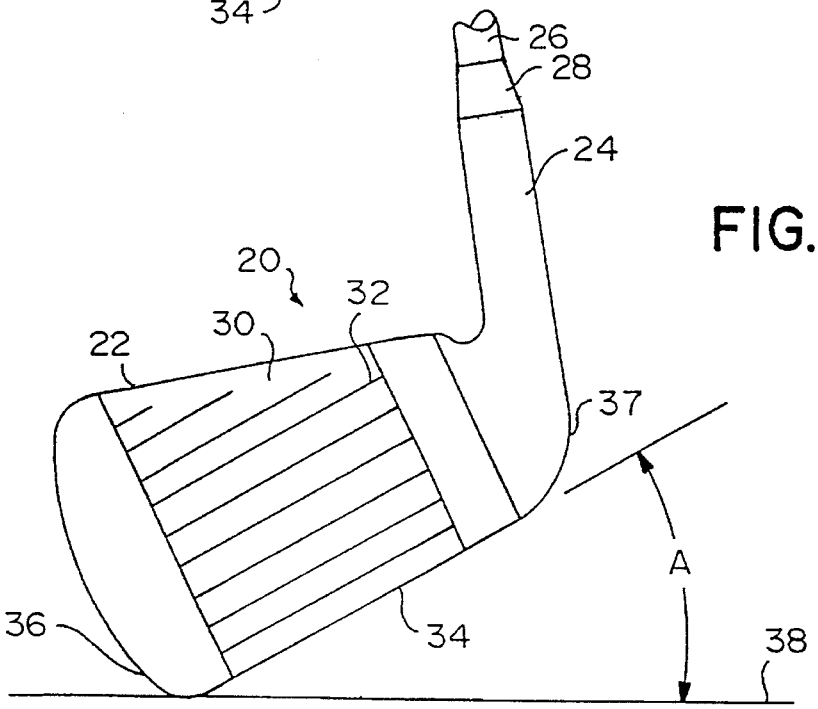
FIG. 2 is a side view showing the golf club head in an undesirable "toe down" lie with respect to the surface.
Figure 3:
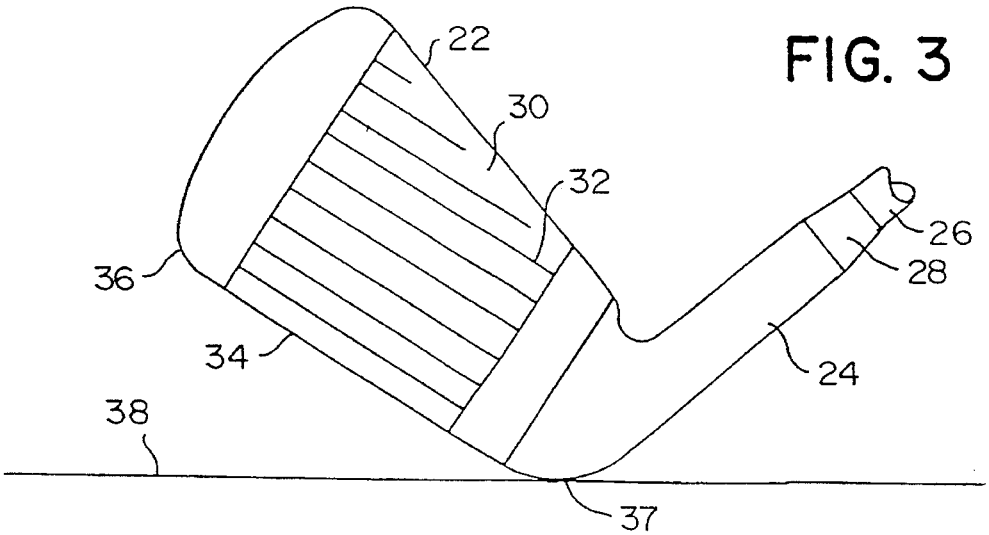
FIG. 3 is a side view showing the golf club head in an undesirable "toe up" lie with respect to the surface.

On occasion, a golfer may not swing the club 20 properly, or may not hold the club properly during the swinging action, which could result in the head 22 being positioned as shown in FIGS. 2 and 3. In FIG. 2, the toe 36 of the head 22 is angled downwardly and the heel 37 is angled upwardly relative to the ground surface line 38. This position of the toe 36, the head 22 and the club 20 is referred to as a "toe down" condition. In FIG. 3, the toe 36 is angled upwardly and the heel 37is angled downwardly relative to the ground surface line 38. This position is referred to as the "toe up" condition.

Heretofore, the techniques for attempting to determine the "toe down" and the "toe up" conditions have not determined the condition at the instant the impact face 30 strikes the ball, which is the most critical time for making an accurate determination of this condition.

The three conditions noted above and illustrated in FIGS. 1, 2 and 3 are referred to as "the dynamic lie" of the club 20. These conditions are dynamic in the sense that they represent the angular orientation of the bottom surface 34 of the head 22 relative to the ground surface line 38 at the instant the impact face 30 strikes the ball. The ideal dynamic lie of the club 20 is illustrated in FIG. 1 where the bottom 34 of the club head 22 is parallel with the ground surface line 38. The dynamic lie as shown in each of FIGS. 2 and 3 illustrate an undesirable lie which requires correction.

Figure 4:
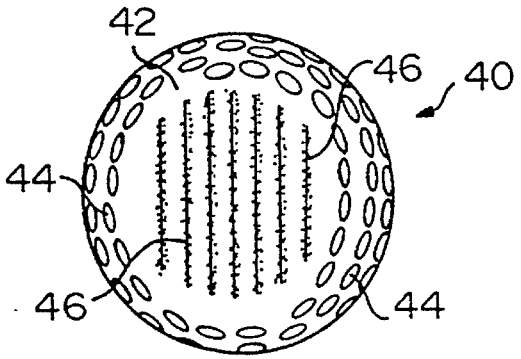
FIG. 4 is a view showing a target object configured as a golf ball formed with a plurality of grooves in a surface of the object in accordance with certain principles of the invention.
Figure 5:
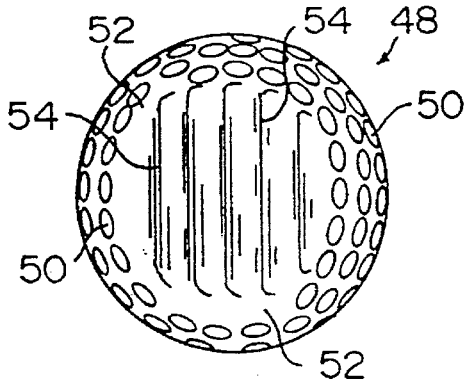
FIG. 5 is a view showing a target object configured as a golf ball formed with a plurality of ridges in a surface of the object in accordance with certain principles of the invention.

In order to determine the dynamic lie of the golf club 20 as it is swung by a particular golfer, a dynamic-lie determination device in accordance with certain principles of this invention is used. In accordance with the preferred embodiment of the invention, the device includes a target object 40 such as, for example, a modified golf ball as shown in FIG. 4. The target object 40 can be a commercially-available conventional golf ball formed with an external curved or spherical surface 42 having a configuration defined by a plurality of dimples or pocks 44 formed in the surface thereof. In accordance with certain aspects of the invention, the surface 42 of target object 40 is formed with one or more alterations such as one or more straight, parallel grooves 46. As shown in FIG. 5, another target object 48 is also formed with a plurality of dimples 50 in an external curved or spherical surface 52 of the object. In further accordance with certain aspects-of the invention, one or more alterations in the form of straight, parallel ridges 54 are formed in the surface 52 and extend outwardly from the surface the target object 48. The grooves 46 and the ridges 54 could be formed as endless grooves and ridges which encircle the respective target objects 40 and 48 on which they are formed such as, for example, the grooves 46 illustrated in FIG. 16.

Examples of a few of the many conventional golf balls which could be modified to form the target objects 40 and 48 are the "Hogan 428" golf ball available from Ben Hogan, Golfball Division, P.O. Box 689, Elyria, Ohio 44036, and the "DDH" golf ball available from Maxfli, 728 North Pleasantburg Drive, Greenville, S.C. 29607. Golf balls of this type include a center core covered with a plastic material. Many other types of golf balls could be used such as, for example, a ball with a liquid core wound with rubber bands and covered with a balata rubber, which is available from Titleist, 333 Bridge Street, P.O. Box 965, Fairhaven, Mass. 02719-0965.

It is noted that, while the target objects 40 and 48 are illustrated with external surfaces 42 and 52, respectively, having dimples 44 and 50, respectively, the surfaces 42 and 52 could be of any configuration, design or pattern without departing from the spirit and scope of the invention. For example, the external surfaces 42 and 52 could be smooth or they could be a combination of configurations. While the configurations of the surfaces 42 and 52 of the target objects 40 and 48, respectively, are not important in the use of the device, it is critically important that the one or more alterations, such as the grooves 46 and the ridges 54, respectively, be straight and, where there are two or more alterations, that they be parallel.

Figure 13:
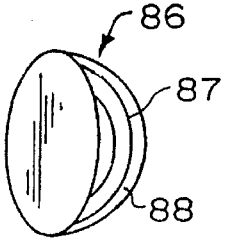
FIG. 13 is a perspective view showing a target object having a partial spherical shape with grooves or ridges formed in a spherical portion of the object in accordance with certain principles of the invention.

As illustrated in FIG. 13, a target object 86 is partially spherical in shape and is formed with grooves or ridges 87 in a curved or spherical surface 88 of the object. Target object 86 can be used in the same manner as target objects 40 and 48, as described below, without departing from the spirit and scope of the invention.

Figure 12:
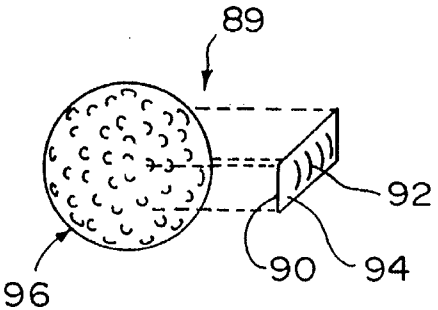
FIG. 12 is a perspective view showing a conventional golf ball and an adhesive-backed strip having grooves or ridges formed therein for assembly with the ball to form a target object in accordance with certain principles of the invention.

In another embodiment of a target object 89 as shown in FIG. 12, a semi-stiff, generally planar material 90 is formed with grooves or ridges 92 on one major surface thereof and an adhesive material on the opposite side major surface thereof. The adhesive surface of the semi-stiff material 90 is applied to the curved or spherical surface of a golf ball 96 to essentially follow the contour of the ball. In this instance, the golf ball 96 would be used as a component of the device in the same manner as the target objects 40, 48 and 86 as described below to determine the dynamic lie of the club 20.

While the foregoing descriptions cover various forms of target objects 40, 48, 86 and 89 which are generally in the spherical shape of a golf ball, objects having shapes other than a spherical shape could be used as a target object in the practice of the invention without departing from the spirit and scope thereof. For example, the impression-making target object could be a block (not shown) with the alterations formed in an outwardly bowed face thereof. The block would be used in the same manner as the target object 40, for example, as described below to determine the dynamic lie of the club 20. The block could be formed in many shapes and configurations without departing from the spirit and scope of the invention as long as the alterations are formed on at least one face of the object and that face is positioned for impact with the impact face 30 of the club 20 when the device is used to determine the dynamic lie of the club as described below.

Figure 14:
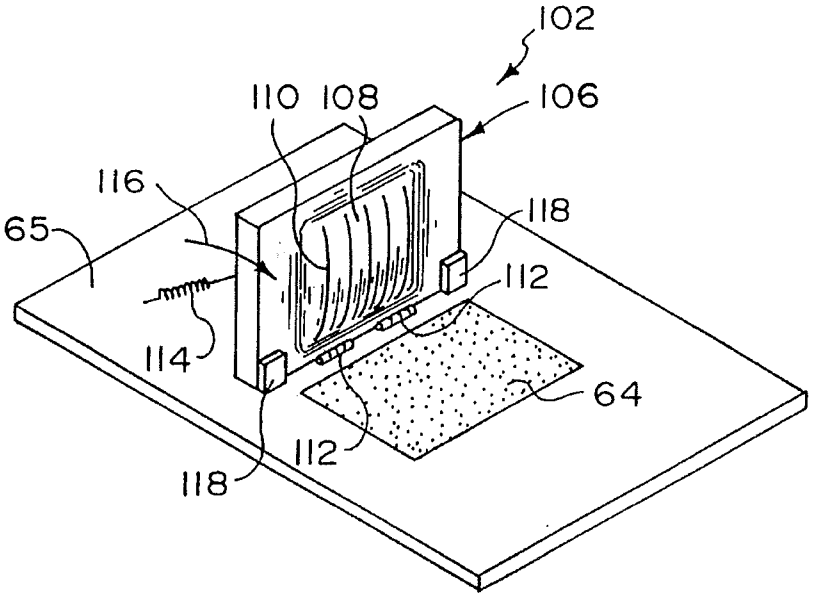
FIG. 14 is a perspective view showing a target object formed in a curved surface of a hinged element mounted on a platform in accordance with certain principles of the invention.

Another non-spherical example is a target object 102, as illustrated in FIG. 14, which is mounted on a stance plate 65 and includes a support 106 having a generally protruding or curved surface 108 formed with grooves or ridges 110. Hinges 112 are used to attach the support 106 to the plate 65 adjacent a special impact surface pad 64 to be described below. One or more biasing elements, such as a spring 114, urge support 106 in the direction of arrow 116. A pair of stops 118 are attached to the plate 65 to limit movement of the support so that the support is normally in an upright position as shown in FIG. 14.

For the purposes of this invention as described and claimed herein, any reference to a target object shall include the alternative constructions such as the block and target objects 40, 48, 86, 89 and 102.

Figure 6:
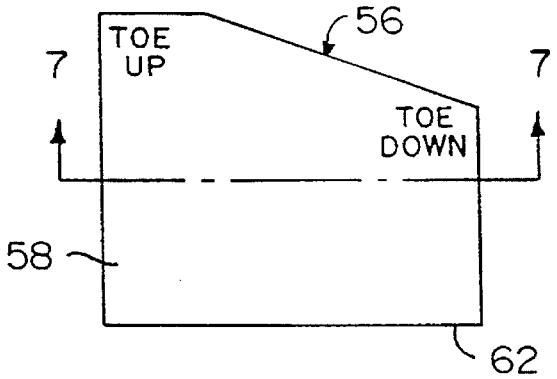
FIG. 6 is a front view of an impressionable media in accordance with certain principles of the invention.
Figure 7:
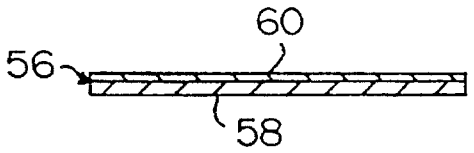
FIG. 7 is a sectional view taken along line 7—7 of FIG. 6 showing the impressionable media with an adhesive backing on one major surface thereof in accordance with certain principles of the invention.
Figure 8:
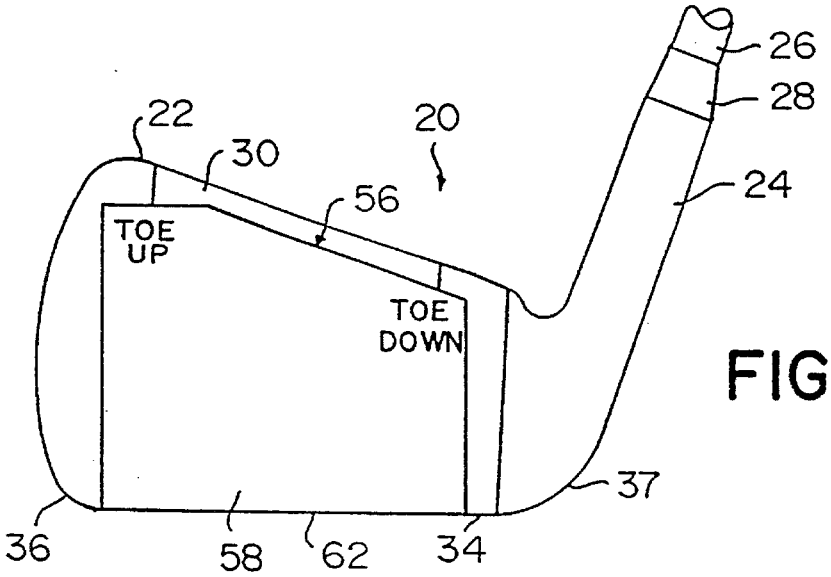
FIG. 8 is a side view of the golf club head of FIG. 1 with the impressionable media of FIG. 6 being adhesively secured to a strike face of the head in accordance with certain principles of the invention.

Referring to FIG. 6, the device of this invention further includes an impressionable medium such as a marker element 56 which is configured for assembly on at least a portion of the impact face 30 of the head 22 as shown in FIG. 8. The element 56 could be, for example, a commercially available masking tape which includes a soft-textured major surface 58 on one side thereof and an adhesive backing 60 on an opposite major surface as illustrated in FIG. 7. Further, the element 56 is formed with a generally straight bottom 62. In general, when the soft-textured surface of such masking tape is subjected to an impact from an impression making object such as, for example, a stencil, the impression of the object will be formed in the soft-textured surface of the masking tape. Any type of medium which, when subjected to impact by an impression-making object, could be used in place of element 56 as a component of the inventive device without departing from the spirit and scope of the invention. For example, some papers are chemically made to reveal a blue-color type of mark when struck by an impression-making object to reveal the impression on the paper in the form of a blue "carbon-copy" outline. An example of such color marking paper is an impression tape available commercially from Longshot Golf, Impact Recording Systems, P.O. Box 277, Sterling Heights, Mich. 48311. Other types of marking materials, such as those disclosed in U.S. Pat. Nos. 2,660,436; 3,754,764; 5,033,746 and 5,142,309 could be used without departing from the spirit and scope of the invention.

For handling purposes, a thin cover paper (not shown) could be initially placed over the adhesive backing 60 of the element 56 and removed just prior to its use in the device in determining the dynamic lie of club 20 as described hereinafter. This would prevent the element 56 from becoming secured to other surfaces before it is time to secure it to the impact face 30. Further, a plurality of elements 56 could be assembled in a tablet form or comparable supply arrangement for ready access when needed. Also, the non-adhesive surface 58 of the element 56 includes the and designations "toe up" and "toe down" in the upper left and right corners, respectively, for a purpose to be described hereinafter. It is noted that the designations on the surface 58 are not required in the use of the inventive device but do enhance such use.

As noted above, element 56 is secured to the impact face 30 of head 22 in the manner illustrated in FIG. 8 where the bottom 34 of the head 22 and the bottom 62 of the element 56 are coincidental. Element 56 could be secured on the impact face 30 such that the bottom 62 of the element is coincidental with the lowest groove 32 on the impact face or is at least parallel with the grooves 32.

Figure 9:
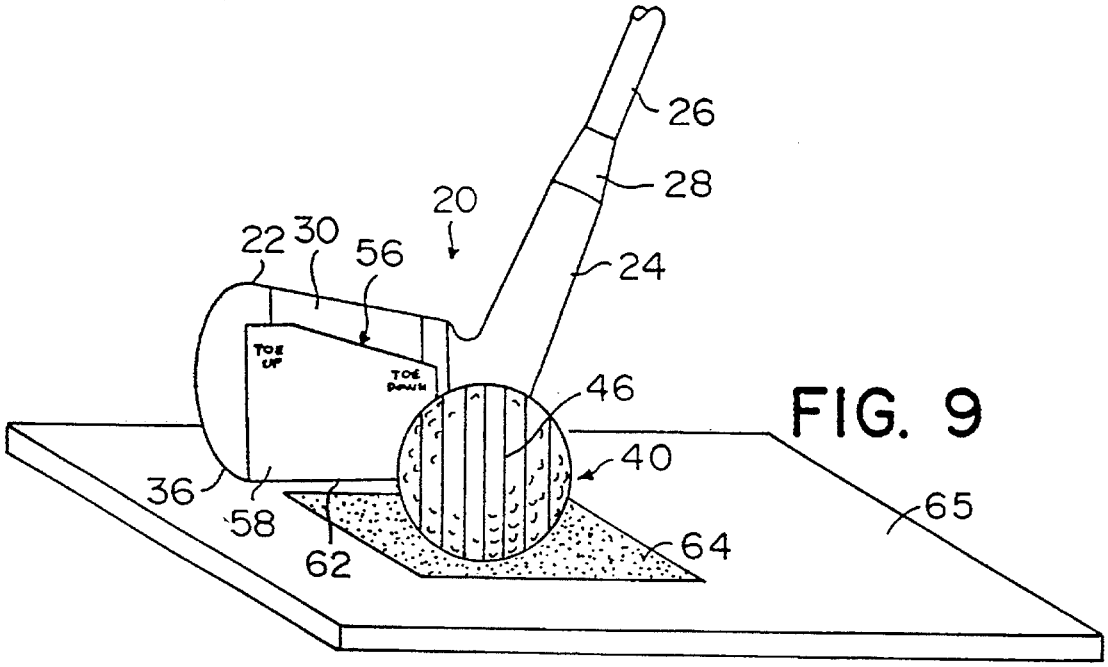
FIG. 9 is a side view of the golf club head and impressionable media of FIG. 8 in position adjacent the target object of FIGS. 4 or 5 immediately prior to impact of the object by the strike face and impressionable media in accordance with certain principles of the invention.

In use of the dynamic lie determination device, and with reference to target object 40, the object is placed on a level surface such as, for example, the special impact surface pad 64 located on the stance plate 65 as shown in FIG. 9 with the grooves 46 of the object being perpendicular to the level plane of the pad. In this manner, the grooves 46 correlate to, and are thereby representative of, the level plane of the grass surface 64. It is noted that stance plate 65 could be composed of a rigid material such as, for example, plywood or a material of comparable rigidity. Also, the surface pad 64 could be composed of a synthetic or artificial turf material which emulates ground conditions for golf shots. An example of such an artificial turf material is that sold under the trademark "ASTROTURF" which is owned by Southwest Recreational Industries, Inc. whose address is P.O. Box 589, 701 Leander Drive, Leander, Tex. 78646. Surface pad 64 also provides a relatively soft surface for the bottom 34 of the club head 22 when the club 20 is swung to hit the target object 40.

It is noted that level surfaces of other compositions could be used with the inventive device as described herein without departing from the spirit and scope of the invention. For example, target object 40 could be placed on a regular grass surface as long as the surface is level.

Figure 10:
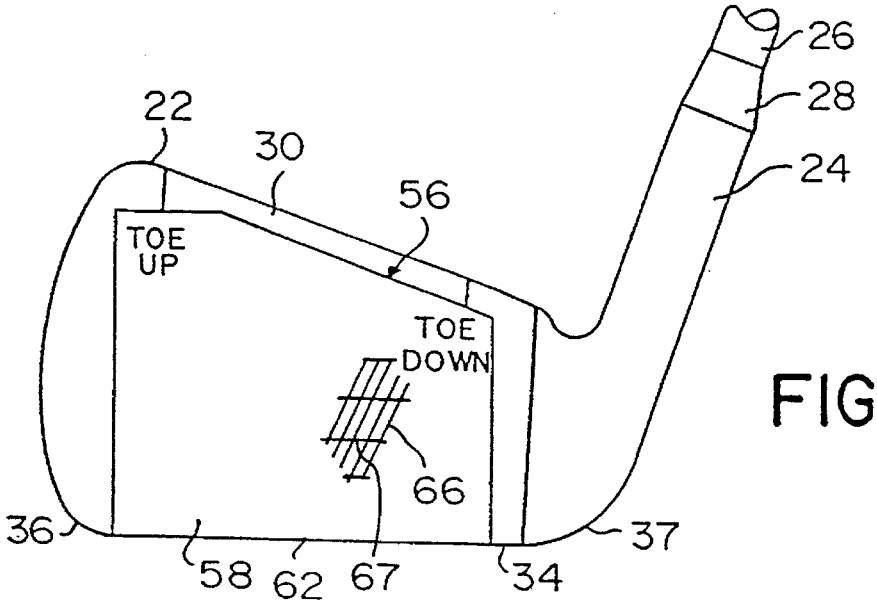
FIG. 10 is a side view of the golf club head and impressionable media of FIG. 8 following impact with the target object of FIGS. 4 or 5 with impression stripes formed in the media by the alterations on the target object and by grooves in the club head in accordance with certain principles of the invention.

After the target object 40 has been placed on the surface pad 64, the club 20 is manipulated so that the impact face 30 with the element 56 secured thereto is aligned with, and faces, the grooves 46 of the target object. The club 20 is retracted by the golfer and swung so that the impact face 30 of the head 22 and the element 56 strike the target object 40 where the grooves 46 of the object engage the soft-textured surface 58 of the element to form an impression therein. Assume for the purposes of illustration that, when the golfer swung the club 20, the club was held in such a manner that the club head 22 assumed the "toe down" position as illustrated in FIG. 2. In this instance, an impression in made in the surface 58 which is represented by a plurality of parallel lines 66 illustrated in FIG. 10 consistent with the pattern and configuration of the parallel grooves 46 formed on the target object 40. In addition, an impression of portions of the grooves 32 of head 22 in the area where the head strikes the target object 40 will also appear on the surface 58 as spaced parallel lines 67 as shown FIG. 10. As further shown in FIG. 10, the lines 66 are angled upwardly and to the left, pointing generally in the direction of the "toe down" designation. This provides a representation of the dynamic lie of the club 20 as swung by this particular golfer at the instant the impact face 30 and the element 56 struck the target device 40. Lines 67 as formed by the grooves 32 of the head 22 provide a reference level for observing, and measuring, the angular tilt of lines 66 and thereby the dynamic lie of the club 20 as described below.

Figure 11:
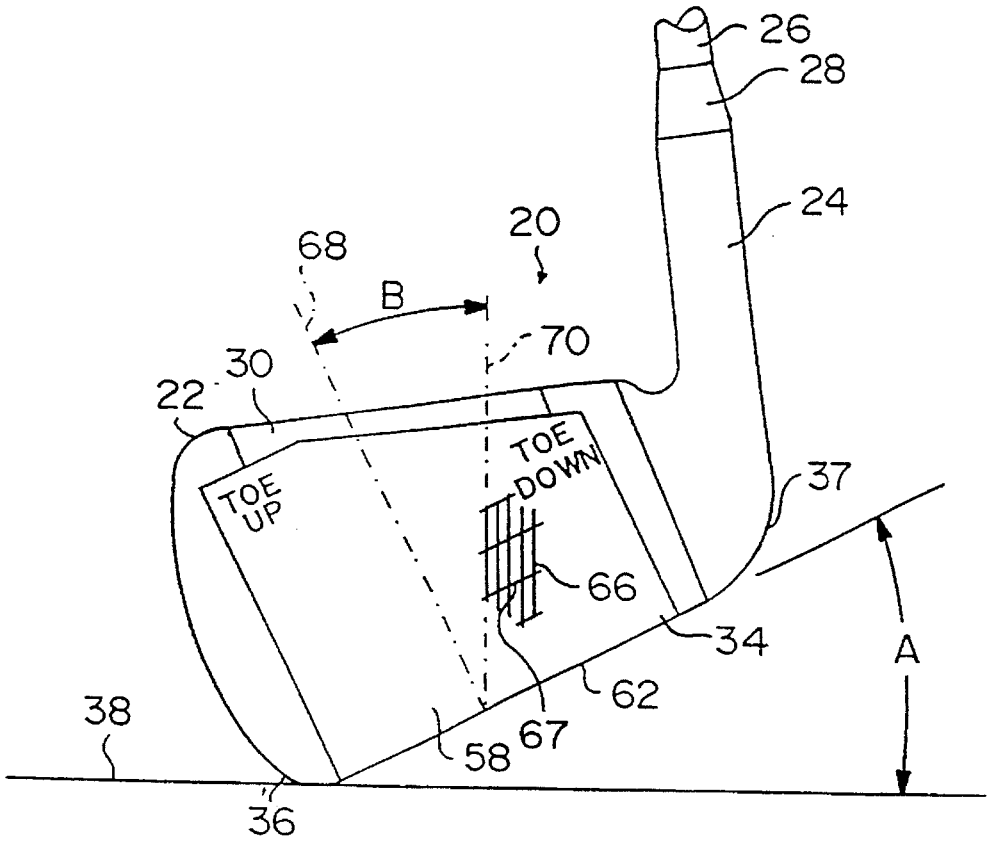
FIG. 11 is a side view as illustrated in FIG. 10 showing the club head tilted to reveal the various angular relationships between the impression stripes and the angle of the club head in accordance with certain principles of the invention.

As illustrated in FIG. 11, the "toe down" condition results in the formation of an angle "A" between the bottom 34 of the club head 22 and the ground surface line 38, or plane of the surface pad 64 (FIG. 9), at the instant the impact face 30 and the element 56 strike the target object 40. Thus, angle "A" represents the dynamic lie of the club 20 at that instant. If the club 20 had been swung in an ideal manner, impression lines would have been formed which would been perpendicular to the bottom 34 of the club head 22 and the lines 67 formed by the grooves 32 of the head 22. As shown in FIG. 11, a centerline 68 represents the orientation of the impression lines formed by target object 40 for an ideal dynamic lie. It is noted that centerline 68 is shown for illustration purposes only. The impression lines 66 resulting from the "toe down" condition are also shown. By drawing a line 70 which intersects centerline 68 and is coincidental with one of the impression lines 66, the angular relation can be determined between the ideal-impression centerline 68 and the coincidental one of the undesirable "toe down" impression lines 66 as represented by an angle "B." By geometric analysis, it is shown that angle "A" is equal to angle "B." Therefore, the angular relationship between the bottom 34 of the club 22, or any of the grooves 32 of the head 22, and the level surface pad 64 at the point of dynamic lie of the club can be determined by using the inventive device to form the impression lines 66. If the precise angle of the dynamic lie is desired, a conventional protractor can be used to measure the angle "B." Instead of using lines 68 and 70 to determine the angle of the "toe down" condition, the user can apply the same analysis to the angular relationship between the impression lines 66 and 67 to determine the dynamic lie angle of the club 20.

Armed with this information regarding the orientation of the impression lines 66, and if desired the precise degrees of angle "B," the golfer can make adjustments to the club 20 and/or his or her swing pattern to make corrections for the just-determined "toe down" condition by use of the inventive device. The golfer can then place the target object 40 on the surface pad 64 again and swing the club 20 for a second time to determine whether the corrective effort was sufficient. If not, further correction can be made until the golfer is satisfied with the dynamic lie of the club 20 when it is swung by the golfer. If desired, the golfer can take several swings at the target object 40 and determine the average dynamic lie and make any necessary corrections based on the average rather than a determination based on a single swing.

The target objects 48, 86 and 89, and the alternatively shaped blocks noted above, could be used in the same manner as described above with respect to target object 40 without departing from the spirit and scope of the invention.

Further, when target object 102 (FIG. 14) is used, club 20 is swung so that the impact face 30 of head 22, with element 56 attached thereto, strikes the grooves or ridges 110 which are formed on the protruding surface 108. Impression lines 66 and 67 are formed in the element 56 as described above. The force of such action causes support 106 to move in a direction opposite the direction of arrow 116 and against the biasing action of spring 114. As soon as the club head 22 clears the support 106, spring 114 urges the support to return to the position illustrated in FIG. 14 against stops 118. The lines 66 and 67 formed on the element 56 are now analyzed as described above in determining the dynamic lie of the club 20.

Figure 15:
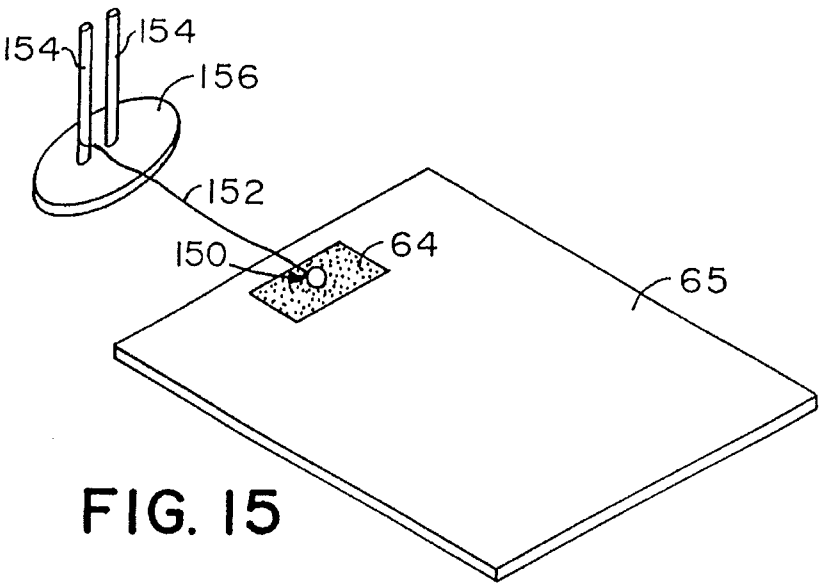
FIG. 15 is a perspective view showing the target object of FIGS. 4 or 5 tethered to a wrap-around post and resting on a platform in accordance with certain principles of the invention.

As shown in FIG. 15, a target object 150, which is representative of any of the above-described objects 40, 48, 86, 89 and 102, is attached to one end of a cord 152. The opposite end of cord 152 is secured or tethered to one of two spaced tubes 154, each of which is secured at the bottom thereof to a heavy-weighted base 156. In use, the base 156 is located a short distance from the stance plate 65. The target object 150 is placed on the surface pad 64 with grooves or ridges of the target object facing in the direction from which the club 20 will be swung. When the target object 150 is struck by the club head 22, the path of flight of the target object is such that the cord 152 will wrap around the tubes 154. The target object 150 is thereby retained within a reasonable distance for retrieval for the next swing of the club 20.

Figure 16:
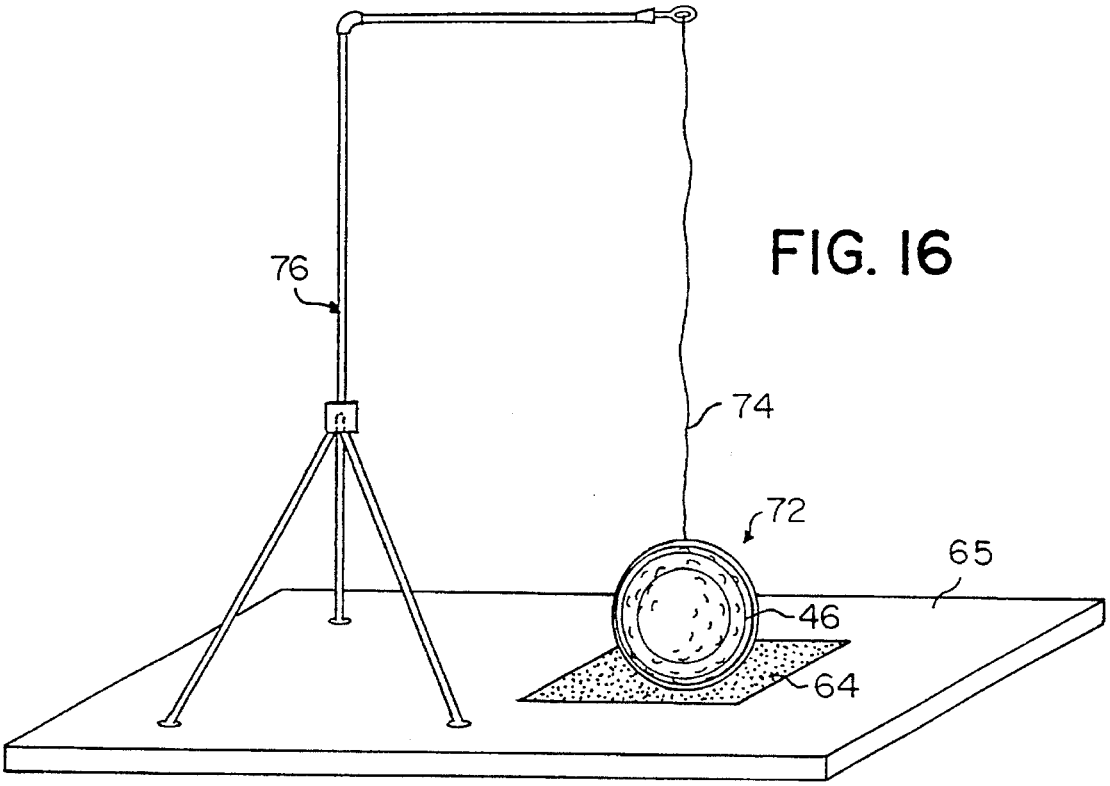
FIG. 16 is a perspective view showing a tripod device for supporting the target object of FIGS. 4 or 5 in a tethered fashion in accordance with certain principles of the invention.

As shown in FIG. 16, a target object 72, which is similar in construction to objects 40 and 48, is attached to a cord 74 at one end of the cord. The other end of the cord 74 is secured to a support frame 76 which is mounted on and secured to the stance plate 64. In this manner, the target object 72 is tethered and is resting on the surface pad 64 in preparation for use in determining the dynamic lie of the club 20. As the target object 72 is struck, the object will be retained in the general area of the surface pad 64 where the object was struck. Thus, the target object 72 does not have to be retrieved for the next use of the device in determining the dynamic lie of the club 20 based on the next swing of the club.

Figure 17:
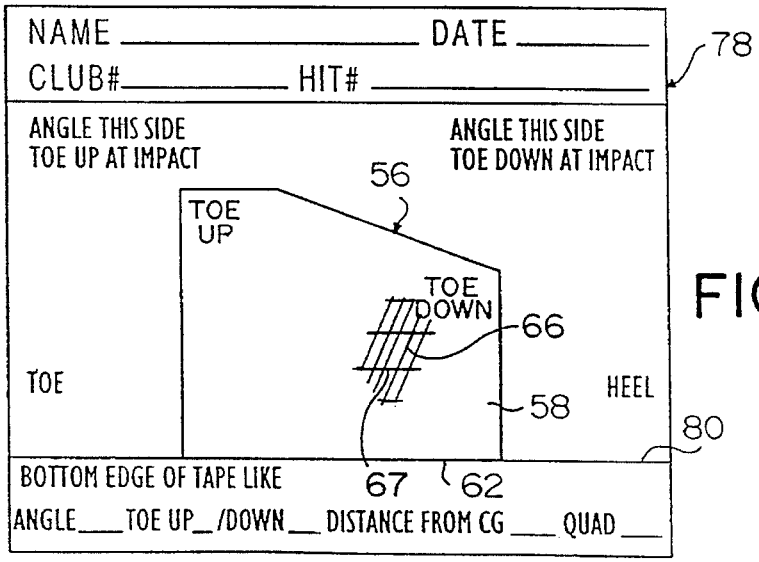
FIG. 17 is a front view showing the impressionable media of FIG. 10 having been removed from the strike face of the club head and assembled with a chart which assists a user/golfer in determining the dynamic lie condition of the club at the instant of impact of the target object by the club head.

As shown in FIG. 17, an information sheet 78 can be used to record data based on a particular golfer's use of the device. Also, the element 56 with the impression lines 66 and 67 thereon can be removed from the impact face 30 of the club head 22 and can be adhesively secured to a central portion of the sheet 78 with the bottom edge 62 of the element being coincidental with a horizontal line 80 on the sheet. With this arrangement, the user can record valuable data derived from the use of the inventive device and can make angular determinations regarding the dynamic lie of the club 20.

In general, the above-identified embodiments are not to be construed as limiting the breadth of the present invention. Modifications, and other alternative constructions, will be apparent which are within the spirit and scope of the invention as defined in the appended claims.

What is claimed is:

1. A device for determining the dynamic lie of a golf club having a head with an impact face, which comprises:

a target object;

an impressionable medium securable to the impact face of the head of the golf club for covering at least a portion of the face which is to be aimed to strike the target object when the club is swung; and an impression-making structure located on the target object, the structure being of a prescribed linear configuration to make an impression in the medium when the medium and the impact face strike the target object indicative of the relative angular position between the structure and the dynamic lie of the club upon striking the target object.

2. The device as set forth in claim 1 wherein the impression medium is a paper.

3. The device as set forth in claim 2 wherein the paper is coated with an adhesive material to facilitate securing of the paper to the impact face of the club head.

4. The device as set forth in claim 1 wherein the medium is formed with a soft textured surface in which an impression can be made by the impression-making structure when the club head strikes the target object.

5. The device as set forth in claim 1 wherein the impressionable medium is a masking tape having a soft textured surface on one side thereof and an adhesive backing on an opposite side thereof.

6. The device as set forth in claim 1 wherein the impression-making structure comprises:

at least one alteration in a surface of the target object formed in a prescribed configuration which relates the angular orientation of the object relative to a surface on which the object rests during use of the device.

7. The device as set forth in claim 6 wherein the alteration is a groove formed in the surface of the target object.

8. The device as set forth in claim 6 wherein the alteration is a ridge formed in and extending from the surface of the target object.

9. The device as set forth in claim 6 wherein the target object comprises:

a member having a curved surface formed thereon; and at least one linear alteration formed on the curved surface.

10. The device as set forth in claim 6 wherein the target object comprises:

a first member having a curved surface thereon;

a second member secured and conforming to the curved surface and having an exposed face; and at least one linear alteration formed on the exposed face.

11. The device as set forth in claim 6 wherein the prescribed configuration is a straight line.

12. The device as set forth in claim 1 wherein the impression-making structure is a plurality of parallel spaced grooves formed in the surface of the target object.

13. The device as set forth in claim 1 wherein the impression-making structure is a plurality of parallel spaced ridges formed in and extending from the surface of the target object.

14. A method of determining the lie of a golf club at the instant an impact face of a head of the club strikes a target object, which comprises the steps of:

forming at least one impression-making structure of prescribed configuration in a face of the target object;

securing an impressionable medium to at least a portion of the impact face of the head of the club relative to a prescribed portion of the head of the club;

placing the target object on a support surface with the impression-making structure on the object being located at a prescribed angular relation to a plane of the support surface;

positioning the impact face of the head with the impressionable medium thereon in alignment with the impression-making structure of the target object;

swinging the club to move the impressionable medium on the impact face into engagement with the impression-making structure on the target object to make an impression thereon; and determining the angular relation between the impression made in the impressionable medium and the prescribed portion of the head of the club as a representation the angular relation between the prescribed portion of the head and the plane of the support surface at the instant the impact face of the head strikes the target object.

15. The method as set forth in claim 14, wherein the step of forming includes the forming of at least two impression-making structures of prescribed configuration in spaced and parallel relation in the face of the target object.

16. The method as set forth in claim 14, wherein the impression-making structure is a groove formed in the face of the target object.

17. The method as set forth in claim 14, wherein the impression-making structure is a ridge formed outwardly in the face of the target object.

18. The method as set forth in claim 14, wherein the impression-making structure is formed in a straight line.

19. The method as set forth in claim 18, wherein the prescribed angular relation between the impression-making structure and the plane of the support surface is that the structure is perpendicular to the plane.

20. The method of claim 14, wherein the method further includes the step of making a soft textured surface in a structure-engaging face of the impressionable medium to facilitate the formation of the impression therein when the medium and the impact face of the head engage the target object.

21. The method as set forth in claim 14, wherein the prescribed portion of the head is the bottom edge of the head and the club has a toe end and a heel end spaced from the toe end and the step of determining the angular relation includes the step of determining whether (1) the bottom edge of the head is parallel with the plane of the support surface, (2) the toe end of the club is angled downward toward the plane of the support surface in a "toe down" condition, or (3) the heel end of the club is angled downward toward the plane of the support surface in a "toe up" condition.

22. The method as set forth in claim 21, wherein the step of determining whether there is a "toe down" condition or a "toe up" condition further includes the step of determining the angle of such condition.

23. The method as set forth in claim 14, wherein the prescribed portion of the head is a groove formed in the impact face of the head and the club has a toe end and a heel end spaced from the toe end and the step of determining the angular relation includes the step of determining whether (1) the groove is parallel with the plane of the support surface, (2) the toe end of the club is angled downward toward the plane of the support surface in a "toe down" condition, or (3) the heel end of the club is angled downward toward the plane of the support surface in a "toe up" condition.

24. The method as set forth in claim 23, wherein there is a "toe down" condition or a "toe up" condition further includes the step of the determining the angle of such condition.

25. The method as set forth in claim 14, which further comprises the step of tethering the target object to limit the travel of the object when it is struck by the head of the club.

26. The method as set forth in claim 14, which further comprises the step of using a protractor in conjunction with the impression formed in the medium and the prescribed portion of the head of the club to determine the precise angle between the prescribed portion of the head and the plane of the support surface at the instant the impact face and the impressionable medium strike the target object.

* * * * *